US005686140A

United States Patent [19]

Stoffel

[11] Patent Number: 5,686,140

[45] Date of Patent: Nov. 11, 1997

[54] METHOD TO PRODUCE A CONTAINER

[75] Inventor: Gerd Stoffel, Konstanz, Germany

[73] Assignee: Lechner GmbH, Germany

[21] Appl. No.: 585,913

[22] Filed: Sep. 21, 1990

[30] Foreign Application Priority Data

Sep. 22, 1989 [DE] Germany ..... 39 31 623.8

[51] Int. Cl.[6] ..... B05D 7/22

[52] U.S. Cl. ..... 427/230; 427/239; 427/388.1; 427/398.1; 427/409

[58] Field of Search ..... 427/239, 230, 427/398.1, 388.1, 409

[56] References Cited

U.S. PATENT DOCUMENTS 2,902,001 9/1959 Colvin ..... 427/239

4,107,359 8/1978 Witt et al. ..... 427/239

4,172,912 10/1979 Noji et al. ..... 427/230

4,254,165 3/1981 Phelps et al. ..... 427/239

4,615,915 10/1986 Takeda et al. ..... 427/239

*Primary Examiner*—Janyce Bell

*Attorney, Agent, or Firm*—Bachman & LaPointe, P.C.

[57] ABSTRACT

A method for producing a container, such as for example a can or tube, for the accommodation of a filling material, wherein after production of the container, its interior is primed and wherein a coating is applied on the primer with a layer thickness of 30–70 um. A plastic, preferably made of a polyolefin or the like, is used as the coating.

6 Claims, No Drawings

METHOD TO PRODUCE A CONTAINER

BACKGROUND OF THE INVENTION

The invention relates to a method for producing a container for the accommodation of a filling material, such as for example a can or tube, wherein the interior thereof is primed after production of the container.

Hitherto, cans, for example, have been produced by pressing, deep drawing or the like. After production they are cut and washed and subsequently dried. Then an inside protective lacquer is customarily sprayed on, to be precise, to a thickness of approximately 6–8 um which, in turn, is dried. The disadvantage lies in the fact that cans or tubes of this type are not resistant to aggressive filling materials.

SUMMARY OF THE INVENTION

The inventor's aim was to develop a method of the abovementioned type, in which a container is provided which has this resistance to aggressive filling materials, and in which, additionally, any seams present are sealed off.

This object is achieved in accordance with the present invention wherein after production of the container the interior is primed and a coating with a layer thickness of 30–70 um is applied on the primer.

DETAILED DESCRIPTION

This relatively thick coating is suitable, above all, for containers for the accommodation of aggressive filling materials. These containers can be tubes or also aluminum cans. Furthermore, the coating is also suitable for white tin cans since the seam generally present in white tin cans is sealed by the coating. However, the coating is also likewise well-suited for plastic cans.

The primer generally has a layer thickness of 20–30 um with the result that a total layer thickness of primer and coating of approximately 50–100 um results.

For the coating, polyolefins or similar substances are suitable, for example, as well as mixtures of polyolefins and other substances. This has the essential advantage that polyolefins burn when the container is recycled, without polluting the environment. However, the coating can also consist of a polyethylene or of other plastics. No limits are to be placed on the innovative concept in this case.

Subsequently, after application of primer and coating, the container is placed in a drying oven and subjected to heat of 160°–190° C. Then the container is preferably cooled down to 40°–50° C.

The external treatment of the container is effected by applying a special single-component basic lacquer which can be dried at low temperatures in order to avoid damaging the inside coating. A covering lacquer is then applied. If appropriate, a printing ink can be applied to the outside of the container, as by interposing the printing ink between the lacquer layers.

Incidentally, such a coating according to the invention is also suitable for a valve lid to be placed on the can at a later point in time. It is used, above all, for aerosol cans.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for producing a container for the accommodation of a filling material, which comprises protecting the interior of the container against aggressive filling materials by applying a primer to the interior of the container, coating the primer with a polyolefin layer having a thickness of 30–70 um, heating after coating with said primer and polyolefin layer to a temperature of 160°–190° C. in a drying oven, and cooling to 40°–50° C. after heating.

2. The method of claim 1 wherein the polyolefin layer contains polyethylene.

3. The method of claim 1, wherein after cooling, the container is provided with an external coating which consists of a first lacquer which is dried at temperatures in order to avoid damage to the inside coating, and wherein a covering lacquer is applied on the first lacquer.

4. The method of claim 3 wherein a printing ink is interposed between the first lacquer and the covering lacquer.

5. The method of claim 1 wherein the primer has a thickness of 20–30 μm so that the total thickness of the primer and coating on the primer is 50–100 μm.

6. The method of claim 1 wherein the entire interior of the container is primed in order to protect same against aggressive filling materials.

* * * * *